US005775543A

United States Patent [19]

Wahrenbrock

[11] Patent Number: 5,775,543

[45] Date of Patent: Jul. 7, 1998

[54] SPRAYERS FOR DISPENSING DETERRENT CHEMICALS

[76] Inventor: Richard N. Wahrenbrock, 587 N. Ventu Park Rd., Unit F, Ste. 903, Newbury Park, Calif. 91320

[21] Appl. No.: 426,120

[22] Filed: Apr. 20, 1995

[51] Int. Cl.[6] ..... B67D 5/06

[52] U.S. Cl. ..... 222/175; 222/401; 222/529

[58] Field of Search ..... 222/175, 105, 222/401, 529, 530

[56] References Cited

U.S. PATENT DOCUMENTS

| | | | |
|---|---|---|---|
| 2,653,848 | 9/1953 | Lee | 222/401 |
| 2,793,073 | 5/1957 | Bateman | 222/175 |
| 3,091,372 | 5/1963 | Tidd | 222/401 |
| 3,095,123 | 6/1963 | Smith, Sr. et al. | 222/529 |
| 4,154,367 | 5/1979 | Hanson et al. | 222/401 |
| 4,688,643 | 8/1987 | Carter et al. | 222/175 |
| 5,072,884 | 12/1991 | Ellison et al. | 222/401 |
| 5,115,947 | 5/1992 | McDonnell et al. | 222/175 |

*Primary Examiner*—Andres Kashnikow
*Assistant Examiner*—Philippe Derakshani
*Attorney, Agent, or Firm*—W. Edward Johansen

[57] ABSTRACT

A sprayer for dispensing a deterrent chemical includes a pump, a tube and a spray discharge nozzle. The tube is fluidly coupled to the pump. The sprayer also includes a flexible bag, a backpack, a shut-off valve and an extension tube. The pump is a slide pump. The flexible liquid bag contains the deterrent chemical. The flexible liquid bag is fluidly coupled to the slide pump. The shut-off valve is fluidly coupled to the tube. The spray discharge nozzle is fluidly coupled to the extension tube. The connector clip can be distachably coupled to the ring. The backpack is coupled to the flexible liquid bag in order to suspend it. The sprayer further includes a ring and a connector clip. The ring is fixedly coupled to the backpack. The connector clip is fixedly coupled to the extension tube. The connector clip is distachably coupled to the ring so that a user may carrier the sprayer on his back without using his hands.

2 Claims, 3 Drawing Sheets

SPRAYERS FOR DISPENSING DETERRENT CHEMICALS

BACKGROUND OF THE INVENTION

The field of the invention is sprayers which dispense deterrent chemicals.

U. S. Pat. No. 5,366,118 teaches a holder for an aerosol canister which has a stem valve and which includes a housing and a cap. The cap has a discharge nozzle and receives the stem valve of the aerosol canister. When depressed the cap will discharge the contents of the aerosol canister at the discharge nozzle in aerosol form as personal defense. Various types of deterrent chemicals are commercially available. One of the most popular is a oleoresin capsicum or pepper composition.

U. S. Pat. No. 4,841,752 teaches a theft deterrent apparatus includes a nozzle such it may be manually and selectively activated by a foot pedal. The nozzle dispenses a disabling fluid chemical upon activation of a control valve by the foot pedal.

U. S. Pat. No. 4,526,298 teaches a hydration system which includes a refillable flexible liquid bag and harnesses which suspend the refillable flexible liquid bag from the shoulders much like a hiker's backpack.

U. S. Pat. No. 5,085,349 teaches a backpack, a flexible plastic bag and a tube. The flexible plastic bag has an outlet which is coupled to the tube. The flexible plastic bag is carried in the pack.

U. S. Pat. No. 3,940,843 teaches a sprayer which includes a tank having a manually operated pump, a flexible hose, a hand manipulated shut-off valve, an extension tube assembly and a spray discharge nozzle. The extension tube assembly has a swivel coupling which permits selective angular adjustment thereof relative to the hand manipulated shut-off valve of a compressed air sprayer. The swivel coupling facilitate accurate "pointing" of the spray discharge mozzle carried by the extension tube assembly.

SUMMARY OF INVENTION

The present invention is generally directed to a sprayer for dispensing a deterrent chemical. The sprayer includes a pump, a tube and a spray discharge nozzle. The tube is fluidly coupled to the pump.

In a first separate aspect of the present invention, the sprayer also includes a flexible bag, a backpack, a shut-off valve and an extension tube. The pump is a slide pump. The flexible liquid bag contains the deterrent chemical. The flexible liquid bag is fluidly coupled to the slide pump. The shut-off valve is fluidly coupled to the tube. The spray discharge nozzle is fluidly coupled to the extension tube. The connector clip can be distachably coupled to the ring. The backpack is coupled to the flexible liquid bag in order to suspend it.

In a second separate aspect of the present invention, the sprayer further includes a ring and a connector clip. The ring is fixedly coupled to the backpack. The connector clip is fixedly coupled to the extension tube. The connector clip is distachably coupled to the ring so that a user may carry the sprayer without using his hands.

In a third separate aspect of the present invention, the sprayer also includes a tank, harness and an extension tube. The tank contains the deterrent chemical. The pump is a hand-manipulated pump. The tank is fluidly coupled to the hand-manipulated pump. The spray discharge nozzle is fluidly coupled to the extension tube. The harness is coupled to the tank in order to support it.

In a fourth separate aspect of the present invention, the sprayer further includes a ring and a connector clip. The ring is fixedly coupled to the harness. The connector clip is fixedly coupled to the extension tube. The connector clip is distachably coupled to the ring so that a user may carry the sprayer without using his hands.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
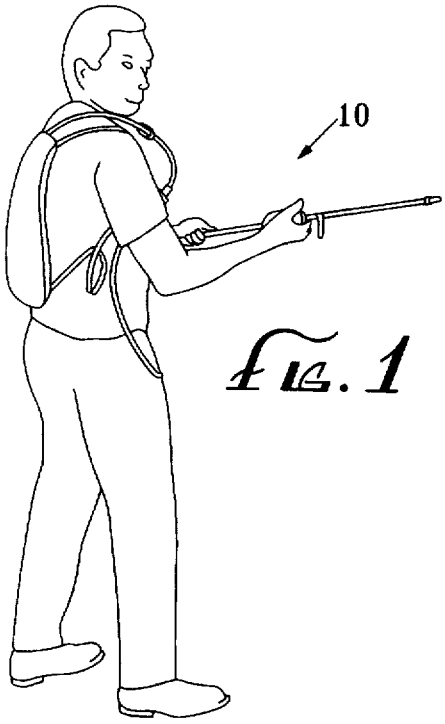
FIG. 1 is a schematic drawing of a man using a sprayer for dispensing a deterrent chemical which includes a backpack, a flexible liquid bag, a tube, a slide pump, a shut-off valve, an extension tube, a connector clip, a ring and a spray discharge nozzle according to the first embodiment.
Figure 2:
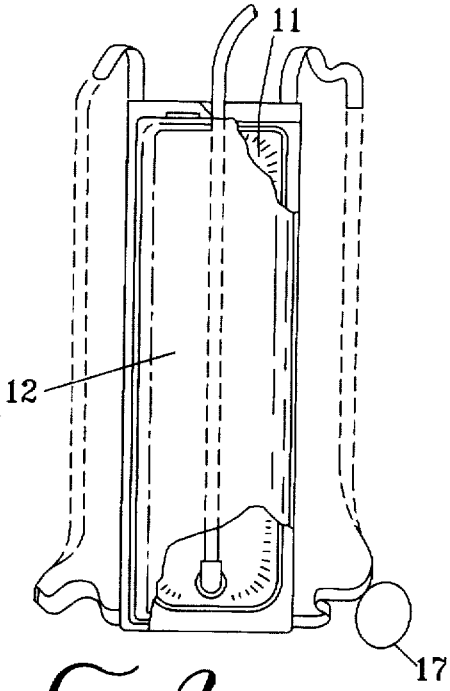
FIG. 2 is a rear elevational view in partial cross-section of the backpack of the sprayer of FIG. 1.

Referring to FIG. 1 in conjunction with FIG. 2 a sprayer 10 for dispensing a deterrent chemical includes a flexible bag 11 and a backpack 12. The backpack 12 is coupled to the flexible bag 11 in order to suspend it. The flexible bag 11 may be formed out of plastic or rubber or canvas.

Figure 3:
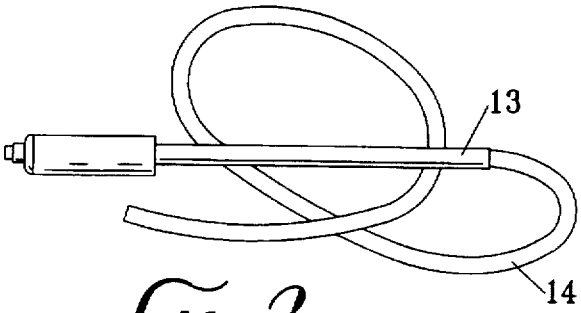
FIG. 3 is a perspective drawing of the slide pump and the tube of the sprayer of FIG. 1.

Referring to FIG. 3 in conjunction with FIG. 1 the sprayer 10 for dispensing a deterrent chemical also includes a slide pump 13 and a tube 14. The tube 14 is fluidly coupled to the slide pump 13. The slide pump 13 is fluidly coupled to the flexible bag 11.

Figure 4:
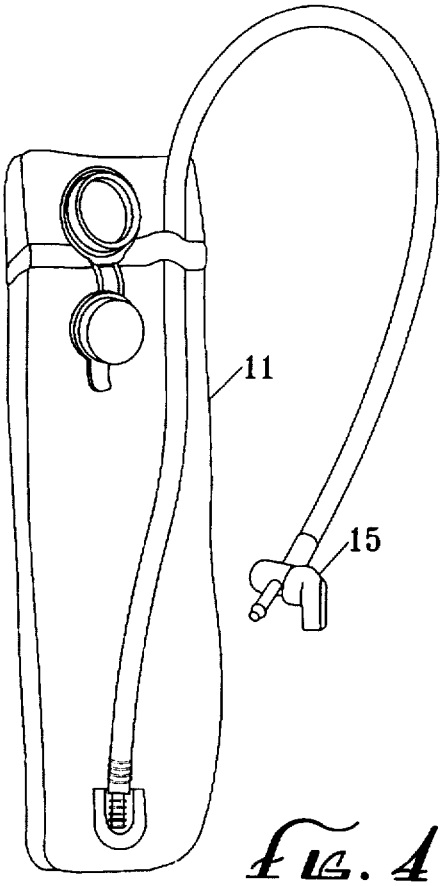
FIG. 4 is a perspective drawing of the flexible bag, the tube and the a shut-off valve of the sprayer of FIG. 1.

Referring to FIG. 4 in conjunction with FIG. 1 the sprayer 10 for dispensing a deterrent chemical further includes a shut-off valve 15. The flexible bag 11 contains a deterrent chemical such as either oleoresin capsicum.

Figure 5:
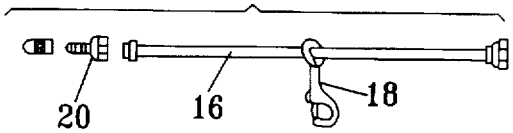
FIG. 5 is a perspective drawing of the extension tube, the connector clip and the spray discharge nozzle of the sprayer of FIG. 1.

Referring to FIG. 5 in conjunction with FIG. 1 the sprayer 10 for dispensing a deterrent chemical still further includes an extension tube 16, a ring 17, a connector clip 18 and a spray discharge nozzle 20. The shut-off valve 15 is fluidly coupled to the tube 14. The extension tube 16 is fluidly coupled to the shut-off valve 15. The ring 17 is fixedly coupled to the backpack 12. The connector clip 18 is fixedly coupled to the extension tube 16. The connector clip 18 is distachably coupled to the ring 17 so that a user may carrier the sprayer 10 on his back without using his hands. The spray discharge nozzle 20 is fluidly coupled to the extension tube 16.

Figure 6:
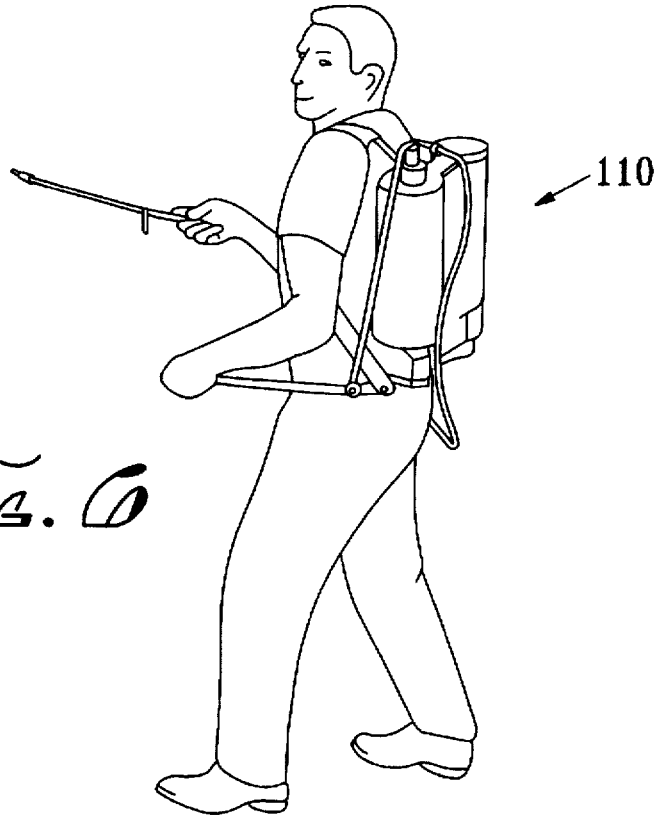
FIG. 6 is a schematic drawing of a man using a sprayer for dispensing a deterrent chemical which includes a tank, a hand-manipulated pump, a tube, a trigger assembly, an extension tube, a connector clip, a ring and a spray discharge nozzle according to the second embodiment.
Figure 7:
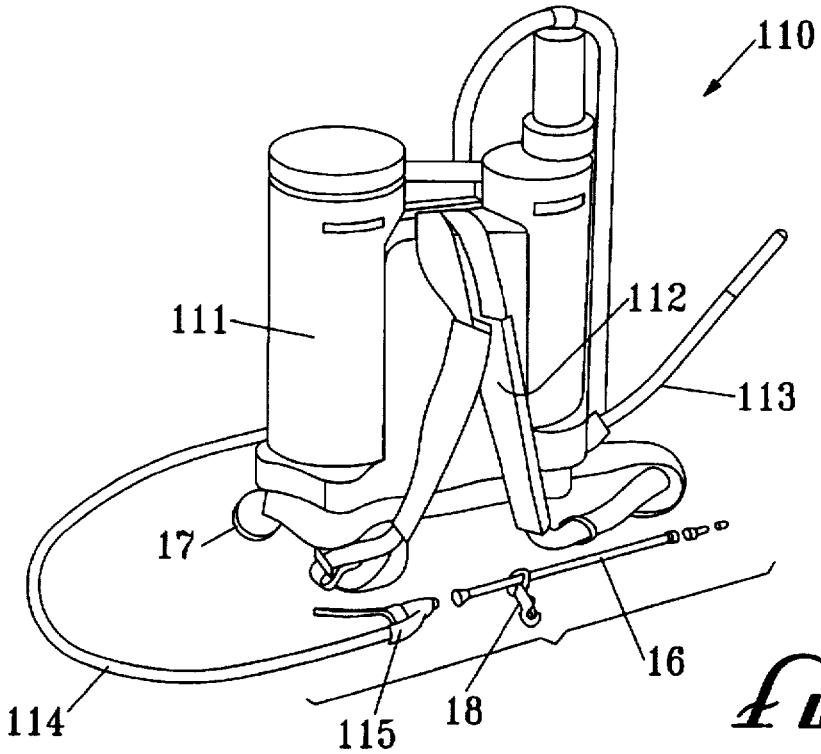
FIG. 7 is a perspective drawing of the sprayer of FIG. 6.

Referring to FIG. 6 in conjunction with FIG. 7 a sprayer 110 for dispensing a deterrent chemical includes a tank 111, a harness 112, a hand-manipulated pump 113, a tube 114, a trigger assembly 115, the extension tube 16, the ring 17, the connector clip 18 and the spray discharge nozzle 20. The tank 111 contains a deterrent chemical such as either oleo-resin capsicum. The harness 112 is coupled to the tank 111 in order to suspend the tank 111. The hand-manipulated pump 113 is fluidly coupled to the tank 111. The tube 114 is fluidly coupled to the hand-manipulated pump 113. The extension tube 16 is fluidly coupled to the tube 114. The ring 17 is fixedly coupled to the harness 112. The connector clip 18 is fixedly coupled to the extension tube 16. The connector clip 18 can be distachably coupled to the ring 17 so that a user may carrier the sprayer 110 on his back without using his hands. The spray discharge nozzle 20 is fluidly coupled to the extension tube 16.

Figure 8:
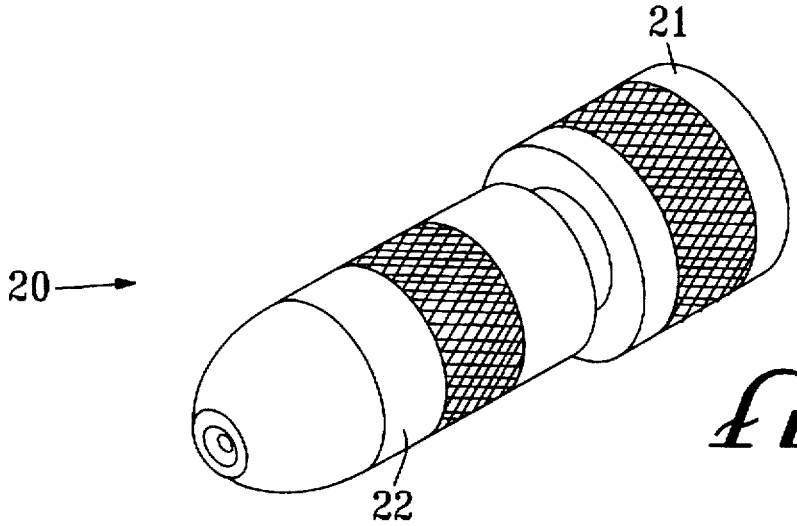
FIG. 8 is a perspective drawing of a spray discharge nozzle of the sprayers of FIG. 1 and FIG. 6.
Figure 9:
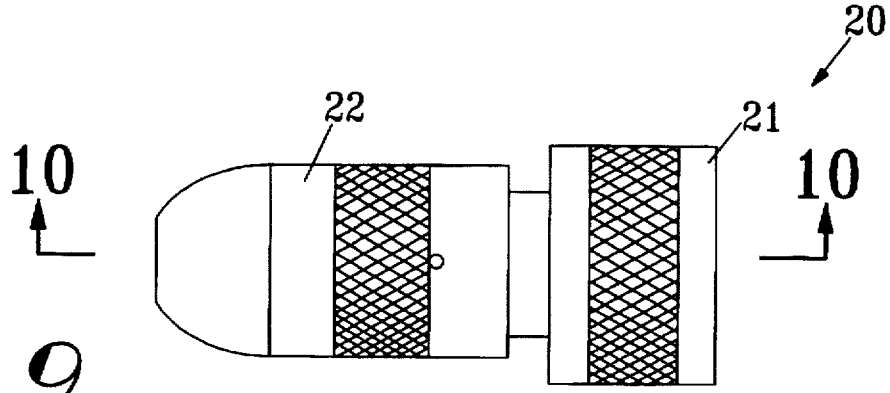
FIG. 9 is a transverse view of the spray discharge nozzle of FIG. 8.
Figure 10:
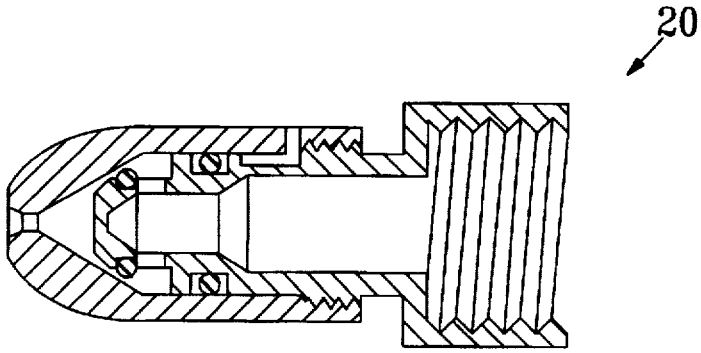
FIG. 10 is a transverse view in cross-section of the spray discharge nozzle of FIG. 8.

Referring to FIG. 8 in conjunction with FIG. 9 and FIG. 10 the spray discharge nozzle 20 includes a base 21 and an outlet piece 22. The base 21 has a first groove 23 and a second groove 24. A first o-ring 25 is disposed in the first groove 23. A second o-ring 26 is disposed in the second groove 24. The base 21 has a rotary groove 27 on the inner surface. The outlet piece 22 has a bore 28 which engages both the first and second o-rings 25 and 26 to positively shut-off the spray discharge nozzle 20. The outlet piece 22 also has a pin hole 29 which is aligned with the rotary groove 27 and in which a pin 30 is inserted in order to engage the rotary groove 27 so that the outlet piece 22 can not be removed. The outer surface of the base 21 is deeply knurled. The outer surface of the outlet piece 22 is deeply knurled so that the outer surface of the base 21 and the other surface of the outlet piece 22 may be firmly grasped in order to be rotated.

From the foregoing it can be seen that a sprayer which dispenses a deterrent chemical has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A sprayer for dispensing a deterrent chemical, said sprayer comprising:

a. a flexible bag for containing the deterrent chemical;

b. a tube fluidly coupled to said flexible bag;

c. a shut-off valve fluidly coupled to said tube;

d. a slide pump fluidly coupled to said shut-off valve;

e. an extension tube fluidly coupled to said slide pump;

f. a spray discharge nozzle fluidly coupled to said extension tube, said spray discharge nozzle including a base which has an outer surface and an inner surface, a first groove on said outer surface, a second groove on said outer surface and a rotary groove on said inner surface, a first o-ring which is disposed in said first groove, a second o-ring which is disposed in said second groove and an outlet piece which has a bore and which engages both of said first and second o-rings to positively shut-off said spray discharge nozzle and which has a hole which is aligned with said rotary groove and in which said pin is inserted in order to engage said rotary groove so that the outlet piece can not be removed; and g. a backpack coupled to said flexible bag in order to suspend said flexible bag.

2. A sprayer for dispensing a deterrent chemical, said sprayer comprising:

a. a tank;

b. a hand-manipulated pump fluidly coupled to said tank;

c. a tube fluidly coupled to said hand-manipulated pump;

d. a shut-off valve fluidly coupled to said tube;

e. an extension tube fluidly coupled to said shut-off valve;

f. a spray discharge nozzle fluidly coupled to said extension tube, said spray discharge nozzle including a base which has an outer surface and an inner surface, a first groove on said outer surface, a second groove on said outer surface and a rotary groove on said inner surface, a first o-ring which is disposed in said first groove, a second o-ring which is disposed in said second groove and an outlet piece which has a bore and which engages both of said first and second o-rings to positively shut-off said spray discharge nozzle and which has a hole which is aligned with said rotary groove and in which said pin is inserted in order to engage said rotary groove so that the outlet piece can not be removed; and g. a harness coupled to said tank in order to suspend said tank.

* * * * *